US005363883A

United States Patent [19]

Weidmann

[11] Patent Number: 5,363,883

[45] Date of Patent: Nov. 15, 1994

[54] THREAD BRAKING DEVICE HAVING MAGNETICALLY DRIVEN SPRING BRAKING MEMBERS

[75] Inventor: Erich Weidmann, Wetzikon, Switzerland

[73] Assignee: Gebruder Loepfe AG, Kempten, Switzerland

[21] Appl. No.: 19,027

[22] Filed: Feb. 18, 1993

[30] Foreign Application Priority Data

Mar. 16, 1992 [CH] Switzerland ..... 834/92-4

[51] Int. Cl.[5] ..... D03D 47/34

[52] U.S. Cl. ..... 139/450; 242/149

[58] Field of Search ..... 242/149; 112/254; 188/65.1; 139/450

[56] References Cited

U.S. PATENT DOCUMENTS 4,274,512 6/1981 Goelz ..... 242/149 X
4,338,975 7/1982 Porter ..... 139/450
4,641,688 2/1987 Gehring ..... 242/149 X
4,969,489 11/1990 Tanaka et al. ..... 139/450

FOREIGN PATENT DOCUMENTS

3148151A1 8/1982 Germany .
676234A5 12/1990 Switzerland .

*Primary Examiner*—Andrew M. Falik
*Attorney, Agent, or Firm*—Harness, Dickey & Pierce

[57] ABSTRACT

The thread braking device comprises a pair of braking members, which are arranged symmetrically in respect to the path of the thread. Each of the braking members has a spring member. Between these spring members a line-shaped, vertically arranged braking zone is defined. For braking, the spring members are pivoted on rockers towards the thread path. Due to this movement as well as due to the vertical arrangement of the spring members, the deposition of contaminations in the braking zone is avoided. The elasticity of the spring members reduces the danger of damage in the presence of thickened thread sections.

9 Claims, 2 Drawing Sheets

THREAD BRAKING DEVICE HAVING MAGNETICALLY DRIVEN SPRING BRAKING MEMBERS

BACKGROUND OF THE INVENTION

1. Field of the Invention

The invention relates to a thread braking device for stopping a running thread, especially as it is used in a textile machine, such as a loom.

2. Description of the Prior Art

Several embodiments of thread braking devices are known. According to one of these embodiments as described in DE-A 31 48 151, the running thread is braked by clamping. For this purpose it is guided between a fixed and a movable braking jaw. The movable braking jaw is actuated by an electromagnet, which magnet is controlled by a thread braking control unit. It has also been proposed to replace the fixed jaw by a somewhat flexible steel ribbon. To open this thread braking device, a spring is used, which disengages the jaws when the electromagnet is not powered. A disadvantage of this embodiment lies in the fact that after a comparatively short period of operation of a few hours ridges are forming along the path of the thread, which are formed of depositions of fibrous material from the thread and of material used in the treatment of the thread. When the jaws are clamped together, they now rest on these ridges and fail to brake the thread efficiently. This leads to loose wefts and therefore to faults in the textile fabric.

In another embodiment according to CH 676 234 braking elements were therefore proposed that were mutually displaceable. In these braking elements the thread is not clamped but deviated and partially wound up for braking. For perfect braking, the thread has to be kept under a minimum tension. This can lead to an increased danger of damaging or breaking very fine, sensitive threads of wool or cotton.

SUMMARY OF THE INVENTION

Hence, it is a general object of the present invention to design a thread braking device whose braking efficiency is not decreased by contaminations and which will not damage or break sensitive threads.

Now, in order to implement these and still further objects of the invention, which will become more readily apparent as the description proceeds, the invention is manifested by the features that two braking members are arranged in pairs symmetrically in respect to the thread. Both braking members are displaceable towards each other such that for braking the thread is compressed between them.

Due to the continuous movement of both of the braking members during opening and closing, the deposition of contaminants is reduced. This is supported by a vertical arrangement of the braking members, such that the contamination particles fall down and leave the braking zone.

In a preferred embodiment flexible springs with hardened surfaces are used as braking members, between which a tapering slit is formed. This reduces the danger of damaging or braking a sensitive thread.

In a preferred embodiment, both braking members are actuated by a common actuating member. Therefore, synchronization problems can be avoided even at very short response times. Closing as well as opening of the brake is carried out by means of magnetic forces. In this way no mechanical wear or fatigue of the actuation mechanism occurs.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
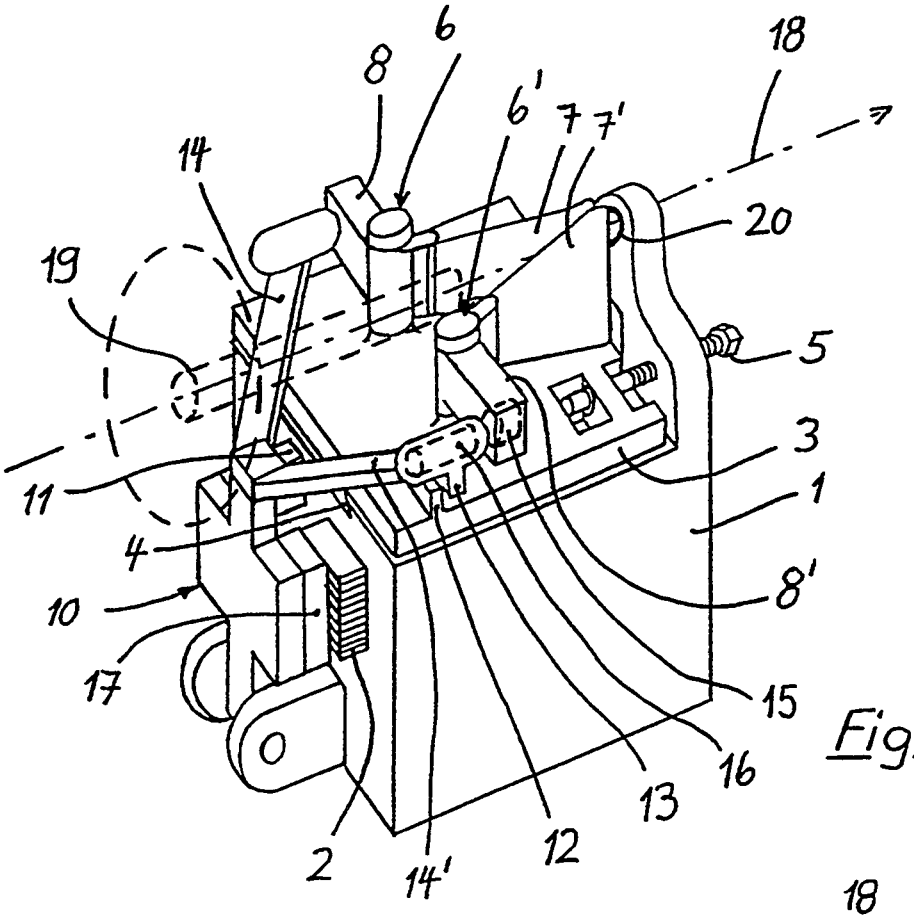
FIG. 1 shows a perspective view of the thread braking device.

The general setup of the braking device is shown in FIG. 1. It is assumed that the device is connected to a control unit for generating the required electric signals. In a weaving machine such a control can e.g. be connected to a detector monitoring the arrival of the projectile. In this way the actuation of the braking device is triggered by a certain position of the projectile, which is given by the position of the detector. In combination with the very fast response time of the braking device, this allows a late and precise braking of the wefts or shoots.

The thread braking device comprises a housing 1. An electromagnet 2 is arranged in this housing and can be activated by a current from the control unit (not shown). Depending on the state of operation of the device, the current can either be zero, positive or negative, as it will be explained below. An adjustable sled 3 on a slider 4 is arranged on top of the housing 1 and positioned by means of a screw 5. The braking members 6, 6' are mounted on the sled 3. They are formed by a pair of spring members 7, 7', which are pivotally arranged on a pair of rockers 8, 8'.

Plate springs of spring steel with chromium-plated or otherwise hardened surfaces are used for the spring members 7, 7'. The spring members are bent at their ends, such that a thin, line-shaped, vertically aligned braking zone is formed between them.

The spring members 7, 7' and the rockers 8, 8' are actuated by means of a common actuating member 10, which is pivotally connected to the housing I and displaceable by magnetic forces between two positions. These two positions are defined by two stops. In a closed state of the braking device, the position of the actuating member 10 is defined by the nose 11 abutting on the housing 1. When opened, ledges 13 on the arms 14, 14' abut on two ledges 12 arranged on the sled 3.

The arms 14, 14' as well as the rockers 8, 8' are made of a smoothly gliding, tough, synthetic material to reduce frictional forces. A first permanent magnet 15 is arranged in each of the rockers 8, 8', and a second permanent magnet 16 is arranged in each of the arms 14, 14', such that the rockers are magnetically coupled to the arms and can be pulled back thereby.

Permanent magnets 17 are arranged on the actuating member 10, which pull the actuating member towards the housing 1 if no current runs through the magnet 2.

In this way, three states of operation can be distinguished in the device. If no current runs through the electromagnet, the actuating member is pulled towards the housing by means of the permanent magnets 17, such that the spring members 7, 7' are pivoted towards each other into a closed position. The force exerted by the string members on the thread is given by the strength of the permanent magnets 17. To open the brake, a current is sent through the electromagnet 2 such that the actuating member is pushed back by magnetic repulsion until the ledges 12 and 13 come into an abutting position. This brings the spring members 7, 7' into an opened position. To close the brake, the polarity of the electromagnet 2 is reversed and a strong magnetic attraction is exerted on the actuating member. The actuating member is pulled to the position where the nose 11 is abutting on the housing 1 and the spring members 7, 7' are brought into a tightly closed position. The braking force is defined by the adjustment of the closing position (cf. FIG. 3). In a second phase of the braking process the braking force can be reduced by removing the current through the electromagnet. As it was mentioned above, the braking force depends in this case only on the strength of the permanent magnets 17. In this way, the brake can be relieved in this second phase of the braking process and the strain on the thread can be reduced.

Figure 2:
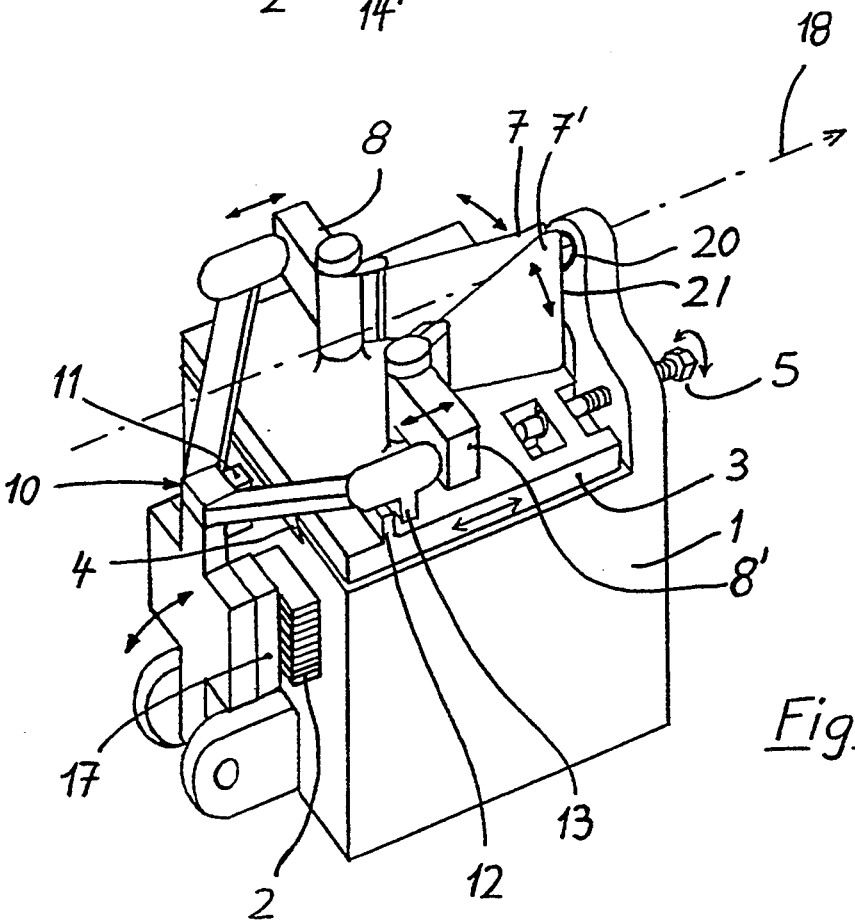
FIG. 2 shows the same view with arrows indicating the movement and adjustment of the brake.

The movements of the individual members during opening and closing are illustrated by arrows in FIG. 2. As it can be seen from this illustration, the braking members 6, 6' are moved symmetrically in respect to the path of the thread. The path of the thread is defined by guiding means 19, 20 arranged before and after the braking members 6, 6' (cf. FIG. 1). In their opened position the braking members 6, 6' do not touch the running thread 18 (cf. FIG. 3A). The movements of the braking members and especially the movements of the spring members 7, 7' as well as the vertical arrangement of their surfaces prevent the deposition of contaminants in the braking zone. Most of the contaminants fall downwards and leave the braking zone.

In the following the operation and adjustment of the braking device is to be explained in more detail. As it was described earlier, the braking members can either be in an opened or in a closed position. The opened position, as it is schematically shown in FIG. 3A, is defined by the ledges 12 on the sled 3 abutting on the ledges 13 of the arms 14, 14'. An adjustment of the sled 3 does not change the position of the opened spring members 7, 7' because the rockers 8, 8' as well as the ledges 13 are arranged on the sled and their relative position remains unchanged. Therefore, even if the closed position of the braking members is changed by an adjustment of the sled 3 in a procedure explained below, the opened position remains unchanged.

Figure 3:
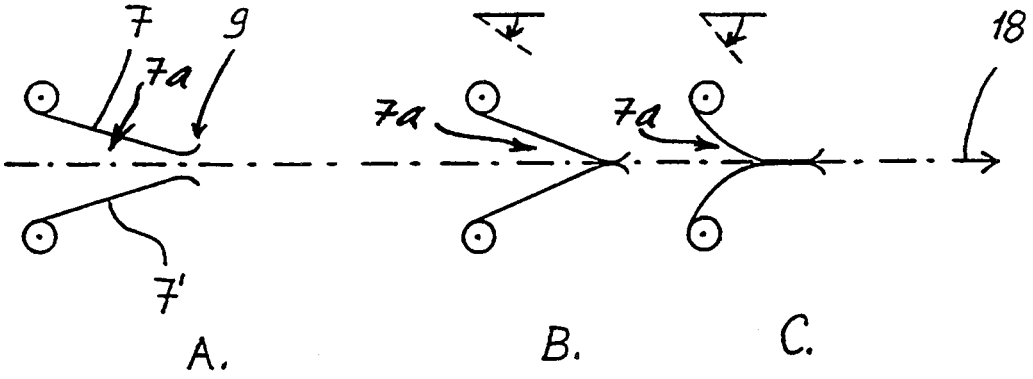
FIG. 3A–3C show a schematic representation of different states of the opened and closed brake.

In the closed position with the electromagnet in attractive operation, the position of the actuating member 10 is given by the nose 11, abutting on the housing 1. If the sled 3 is now translated by means of the screw 5, the pivotal position of the rockers 8, 8' is changed. A translation of the sled 3 contrary to the forward direction of the thread causes the spring members 7, 7' to be pushed together more strongly, as it can be seen from FIGS. 3 B and 3 C. In FIG. 3B the spring members 7, 7' are just touching, while they are strongly compressed and thereby elasticity deformed in FIG. 3C. In this way the braking force exerted on the thread can be adjusted easily.

If the brake is relieved and no current is sent through the magnet, the braking force is given by the strength of the permanent magnets 17.

From the FIGS. 3 B and C it can also be seen that the presence of a thickened section of thread does not lead to damaging or breaking the thread, since the elastic spring members 7, 7' can yield while maintaining the braking force.

The plate springs used as spring members are arranged such that they form a symmetrical, tapering slit *7a* in their closed position, where the thread can be braked without being damaged. Furthermore, the spring members 7, 7' are shaped to have their maximum vertical extension 21 at the braking zone. Therefore, even if the thread is displaced from its path, it still remains between the spring members 7, 7'.

In this way it is possible to quickly brake the thread without damaging it.

Since the braking device does not comprise any parts that are worn out quickly and since the deposition of contaminants in the braking zone is reduced, continuous operation with a constant, known braking force is guaranteed.

While there is shown and described a present preferred embodiment of the invention, it is to be distinctly understood that the invention is not limited thereto, but may be otherwise variously embodied and practiced within the scope of the following claims.

I claim:

1. A thread braking apparatus for braking a thread running along a thread path into a thread direction, said thread braking apparatus comprising:

at least one pair of braking members, each of said braking members comprising a spring member, wherein said spring members are arranged on opposite sides of said thread path and wherein each said braking member is pivotal for compressing said thread between said spring members, and a common actuating member being magnetically driven and displaceable against said braking members for pivoting said braking members.

2. The thread braking apparatus of claim 1, wherein said common actuating member is driven by a magnetic assembly, said magnetic assembly comprising a permanent magnet and an electromagnet, said permanent magnet and said electromagnet being arranged such that, in the absence of a current throughout said electromagnet said permanent magnet is attracted with a first force towards said electromagnet, in the presence of a first current through said electromagnet said permanent magnet is attracted with a second force by said electromagnet, said second force being stronger that said first force, and in the presence of a second current through said electromagnet in a direction opposite to said first current said permanent magnet is repulsed from said electromagnet.

3. The threaded braking apparatus of claim 2, wherein said permanent magnet is mounted on said actuating member.

4. The thread braking apparatus of claim 1 wherein said braking members and said actuating member comprise magnetic coupling means for coupling said actuating member to said braking members.

5. The thread braking device of claim 1 comprising a housing and a sled slideably mounted on said housing, wherein said braking members are mounted on said sled.

6. The thread braking apparatus of claim 5 wherein said sled provides a first stopper means against which said stopper means said actuating member rests when said braking device is in an open position.

7. The thread braking apparatus of claim 5, wherein said actuating member is pivotally mounted on said housing.

8. The thread braking apparatus of claim 7, wherein in a closed position of said braking device said actuating member abuts said housing.

9. A thread braking apparatus having a braking zone for braking a thread running along a thread path into a thread direction, said thread braking apparatus comprising:

at least one pair of braking members, each said braking member forming a spring member arranged symmetrically with respect to said thread path to form a slit being tapered toward said braking zone and being displacable towards each other for braking said thread by compressing said thread therebetween; and each of said spring members having a vertical length which increases along said thread direction toward said braking zone.

* * * * *